US006547890B2

(12) United States Patent
Kanisawa et al.

(10) Patent No.: US 6,547,890 B2
(45) Date of Patent: Apr. 15, 2003

(54) STEEL WIRE ROD FOR COLD FORGING AND METHOD FOR PRODUCING THE SAME

(75) Inventors: Hideo Kanisawa, Muroran (JP); Tatsuro Ochi, Muroran (JP); Manabu Kubota, Muroran (JP); Koji Tanabe, Muroran (JP); Kiichiro Tsuchida, Muroran (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/829,768

(22) Filed: Apr. 10, 2001

(65) Prior Publication Data

US 2002/0040744 A1 Apr. 11, 2002

(51) Int. Cl.[7] ..... C21D 8/06; C22C 38/02; C22C 38/04; C22C 38/18; C22C 38/08

(52) U.S. Cl. ..... 148/320; 148/330; 148/333; 148/334; 148/335; 148/336; 148/598

(58) Field of Search ..... 148/598, 599, 148/320, 330, 333–336

(56) References Cited

PUBLICATIONS

Misumi, Kenji et al., English abstract of Japanese patent 404147918A, published May 21, 1992.*

Yamazaki, Takeshi et al, English abstract of Japanese patent 362253724A published Nov. 5, 1987.*

* cited by examiner

*Primary Examiner*—Deborah Yee
(74) *Attorney, Agent, or Firm*—Kenyon & Kenyon

(57) ABSTRACT

The present invention provides a steel wire rod for cold forging which can be spheroidizing-annealed in an as hot-rolled state without requiring preliminary drawing and can have high ductility after the spheroidizing annealing, and a method to produce the same: and is characterized in that; the steel contains, by weight, 0.1 to 0.5% of C, 0.01 to 0.5% of Si and 0.3 to 1.5% of Mn, with the balance consisting of Fe and unavoidable impurities, and further contains hardening elements as required; and the steel has a prior austenite grain size number, defined under Japanese Industrial Standard (JIS) G 0551, of 11 or higher, the amount of diffusible hydrogen in the steel measured by the programmed temperature gas chromatography being 0.2 ppm or less, and the hardness being Hv 250 to 700. The production method is characterized by: hot rolling the steel at a low temperature; rapidly cooling and tempering the wire rod thus rolled by holding it in a furnace atmosphere controlled in the temperature range of 300 to 600° C. for 15 min. or longer but shorter than 1 h.; and then applying spheroidizing annealing as required.

6 Claims, 3 Drawing Sheets

STEEL WIRE ROD FOR COLD FORGING AND METHOD FOR PRODUCING THE SAME

BACKGROUND OF THE INVENTION

1. Field of the Invention

This invention relates to a steel wire rod for cold forging used for manufacturing machine structural components such as car and construction machine components and the like, and a method to produce the same.

2. Description of the Related Art

Machine structural components such as those of cars and construction machines, for example bolts, stabilizers, and the like, have been manufactured conventionally through the cold forging of steel wire rods of carbon steels for machine structural use or alloy steels.

In other words, steel wire rods of carbon steels for machine structural use or alloy steels hot rolled and left to cool to room temperature are commercially available, and secondary manufacturers manufacture the formed machine components from the steel wire rods, in most cases, through the following sequential processes: a preliminary drawing at an area reduction of 15 to 30% and then a spheroidizing annealing to secure cold workability; a finish drawing to obtain accurate dimensions and smooth surfaces; a cold forging (such as thread rolling and the like) for forming; and a heat treatment for quenching and tempering.

The reason why the preliminary drawing is conducted is that, since the structure of a hot-rolled wire rod consists of ferrite and lamellar pearlite and it is difficult to apply spheroidizing annealing to the as hot-rolled material, it is necessary to fragment pearlite lamellae (cementite) and give drawing strain to the material through the preliminary drawing as a pretreatment to the spheroidizing annealing.

However, the preliminary drawing at secondary manufacturers is not desirable, for it constitutes an additional process and thus not only lowers productivity but also increases manufacturing costs.

Various technologies to accelerate spheroidizing have been known, such as those proposed in Japanese Unexamined Patent Publications No. S56-119727, No. S57-45929, No. S60-152627, No. H6-336620, etc.

However, the technology disclosed in the Japanese Unexamined Patent Publication No. S56-119727 requires cold drawing, and another disclosed in Japanese Unexamined Patent Publication No. S59-5702 requires a rapid cooling after hot rolling to impose plastic strain on the material. Japanese Unexamined Patent Publications No. S58-164731 and No. H6-336620 disclose technologies to form a martensite structure through rapid cooling after hot rolling. However, no technologies have been disclosed in relation to applying the spheroidizing annealing without preliminary drawing and realizing high ductility as a result of such a spheroidizing annealing.

SUMMARY OF THE INVENTION

In view of the above situation, the object of the present invention is to provide a steel wire rod for cold forging which can be spheroidizing-annealed in an as hot-rolled state without preliminary drawing and rendered highly ductile through the spheroidizing annealing, and a method to produce the same.

The inventors of the present invention directed attention to the facts that, to obtain a good spheroidized structure equivalent to the structure of a wire rod subjected to the conventional process of applying preliminary drawing prior to the spheroidizing annealing, it was important to homogeneously distribute carbon in the steel structure before the spheroidizing annealing so as to reduce the distance of carbon diffusion during the spheroidizing annealing, and that a bainite or a martensite structure containing evenly distributed carbon was the most suitable for the purpose. Based on this, the present inventors discovered that it was possible to eliminate the preliminary drawing prior to the spheroidizing annealing and obtain high ductility through the spheroidizing annealing by forming fine crystal grains through a low temperature rolling in order to facilitate the carbon diffusion, and by properly designing a cooling process so that a martensite, bainite or bainite-martensite structure could be obtained; and established the present invention on the basis of the finding.

The gist of the present invention, therefore, is as follows:

(1) A steel wire rod for cold forging, characterized by: containing, in weight, 0.1 to 0.5% of C, 0.01 to 0.5% of Si, and 0.3 to 1.5% of Mn, with the balance consisting of Fe and unavoidable impurities; and having the prior austenite grain size number defined under Japanese Industrial Standard (JIS) G 0551 being 11 or higher, the amount of diffusible hydrogen in the steel measured by the programmed temperature gas chromatography being 0.2 ppm or less, and the hardness being Hv 250 to 700.

(2) A steel wire rod for cold forging, characterized by: containing, in weight, 0.1 to 0.5% of C, 0.01 to 0.5% of Si, and 0.3 to 1.5% of Mn, with the balance consisting of Fe and unavoidable impurities; and having the ferrite crystal grain size number defined under JIS G 0552 being 11 or higher, and the spheroidizing index defined under JIS G 3545 being No. 2 or below.

(3) A steel wire rod for cold forging according to the item (1) or (2), characterized by further containing, in weight, one or more of 0.2 to 2.0% of Cr, 0.1 to 1.0% of Mo, 0.3 to 1.5% of Ni, 1.0% or less of Cu, and 0.005% or less of B.

(4) A steel wire rod for cold forging according to any one of the items (1) to (3), characterized by further containing, in weight, one or more of 0.005 to 0.04% of Ti, 0.005 to 0.1% of Nb, and 0.03 to 0.3% of V.

(5) A method to produce a steel wire rod for cold forging characterized by hot rolling a steel having a chemical composition specified in any one of the items (1), (3) and (4) at a finish rolling temperature range from the $Ar_3$ transformation temperature to 200° C. above it, rapidly cooling the steel wire rod thus rolled by laying it on a conveyer in the form of continuous rings in order to form a martensite, bainite or bainite-martensite structure and, after collecting the wire rod into a bundled coil and before banding it, tempering the coiled wire rod by holding it in a furnace atmosphere controlled to a temperature range from 300 to 600° C. for 15 min. or longer but shorter than 1 h., so that the prior austenite grain size number defined under JIS G 0551 is 11 or higher, the amount of diffusible hydrogen in the steel measured by the programmed temperature gas chromatography is 0.2 ppm or less, and the hardness thereof is Hv 250 to 700.

(6) A method to produce a steel wire rod for cold forging characterized by applying spheroidizing annealing subsequent to the production processes according to the item (5) so that the ferrite crystal grain size number defined under JIS G 0552 is 11 or higher, and the spheroidizing index defined under JIS G 3545 is No. 2 or below.

BRIEF DESCRIPTION OF THE DRAWINGS

FIG. 1(*a*) shows conventional processes and FIG. 1(*b*) the processes according to the present invention.

DESCRIPTION OF THE PREFERRED EMBODIMENTS

Figures 1A, 1B:
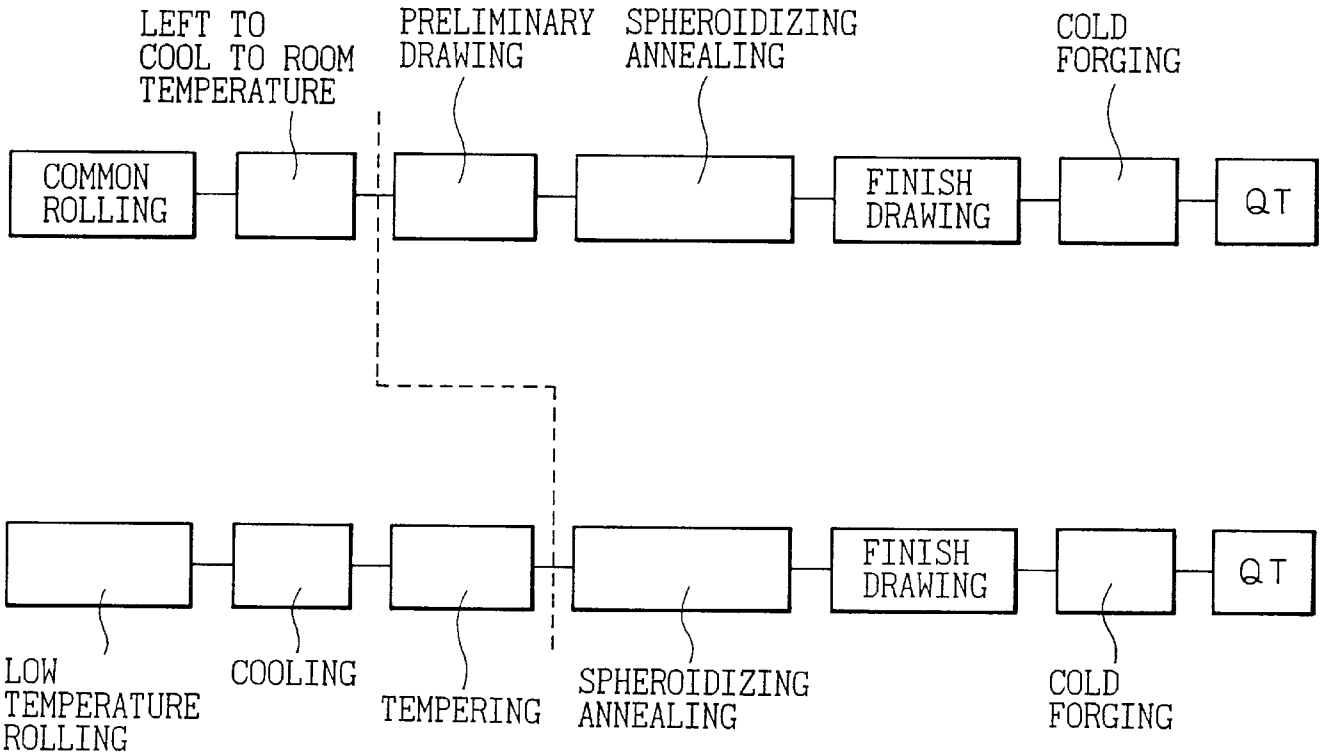
FIG. 1(*a*) and FIG. 1(*b*) are diagrams showing the manufacturing processes of cold forged machine structural components.

Machine structural components such as bolts, stabilizers, etc. have been manufactured conventionally by cold forging. As shown in FIG. 1(*a*), carbon steels for machine structural use or alloy steels are hot rolled at 900° C. and then left to cool in room temperature atmosphere to produce wire rods. Then the wire rods are formed into machine structural components through preliminary drawing and spheroidizing annealing to secure cold workability, finish drawing and cold forging such as thread rolling and the like to shape the components, and then heat treatment for quenching and tempering to harden the products.

However, the preliminary drawing is usually conducted by secondary or tertiary manufacturers who manufacture the components, and is not desirable since it constitutes an additional process and thus not only lowers productivity but also increases the manufacturing costs of the products.

As a result of researches into a manufacturing method to eliminate the preliminary drawing, the present inventors discovered that the spheroidizing annealing could be made viable without the preliminary drawing and that high ductility wire rods could be obtained through the spheroidizing annealing by properly combining low temperature rolling and cooling methods of steel materials having specific chemical composition as shown in FIG. 1(*b*).

The present invention, which is accomplished on the basis of the above discovery, forms fine crystal grains by means of low temperature rolling and a martensite, bainite or bainite-martensite structure by means of rapid cooling, and thus disperses carbon and reduces the distance of carbon diffusion during the spheroidizing annealing so as to facilitate the carbon diffusion. For this purpose, the present invention stipulates that the prior austenite grains have to be so fine as to have a prior austenite grain size number of 11 or above as defined under JIS G 0551. When the prior austenite grain size number is below 11, the carbon diffusion during the spheroidizing annealing is insufficient and thus a quantity of cementite granules enough to secure the cold workability is not obtained. Further, a tempering heat treatment is applied after the cooling so that the steel hardness may become Hv 250 to 700.

In the present invention, if a hot-rolled steel material is cooled from the austenite zone at a cooling rate to form a martensite, bainite or bainite-martensite structure, delayed failure (a phenomenon of a quenched steel material cracking while kept at room temperature) is likely to occur owing to residual stress forming inside the steel material and the inevitable contamination by diffusive hydrogen. By the present invention, however, the stress is relieved and the diffusive hydrogen is removed at the same time by the tempering heat treatment after the cooling. To prevent the delayed failure, it is necessary to reduce the amount of the diffusive hydrogen, measured by the programmed temperature gas chromatography, to 0.2 ppm or less. When the amount exceeds 0.2 ppm, the occurrence of the delayed failure cannot be prevented effectively. As a result of the tempering, furthermore, the material hardness is controlled to Hv 250 to 700.

Figure 2A:
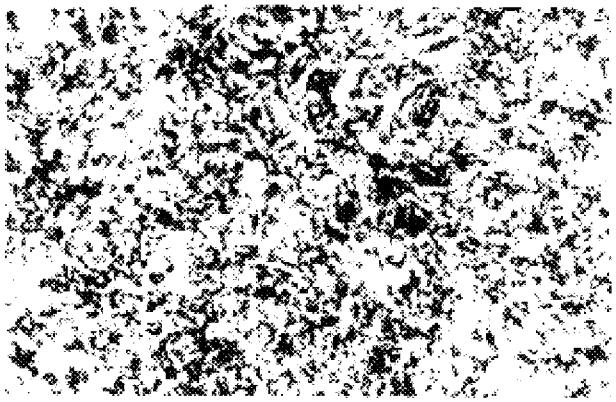
FIG. 2(*a*) and FIG. 2(*b*) are micrographs of the metallographic structures of the materials before spheroidizing annealing: whereas FIG. 2(*a*) shows an example according to the present invention, FIG. 2(*b*) shows an example of conventional materials.
Figure 2B:
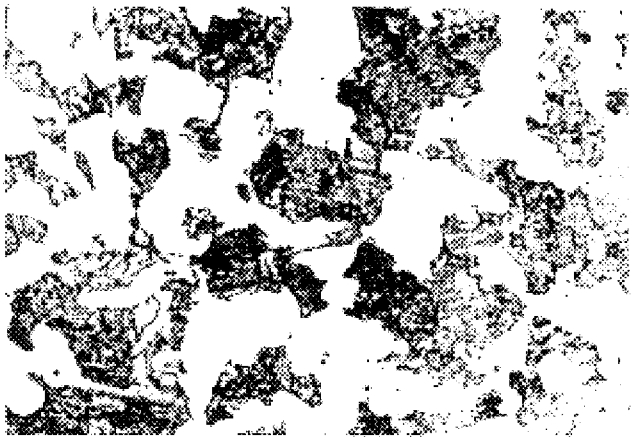

FIG. 2(*a*) and FIG. 2(*b*) are micrographs (×1,000) of the materials prior to spheroidizing annealing. FIG. 2(*a*) is a micrograph of an example according to the present invention prepared through low temperature rolling, cooling with cold water and tempering to form a martensite structure; and FIG. 2(*b*) is that of an example of conventional materials prepared through hot rolling and natural air cooling to form a ferrite and pearlite structure. Comparing FIG. 2(*a*) and FIG. 2(*b*), it is appreciated that the structure of the material according to the present invention has finer crystal grains than the conventional material.

Figure 3A:
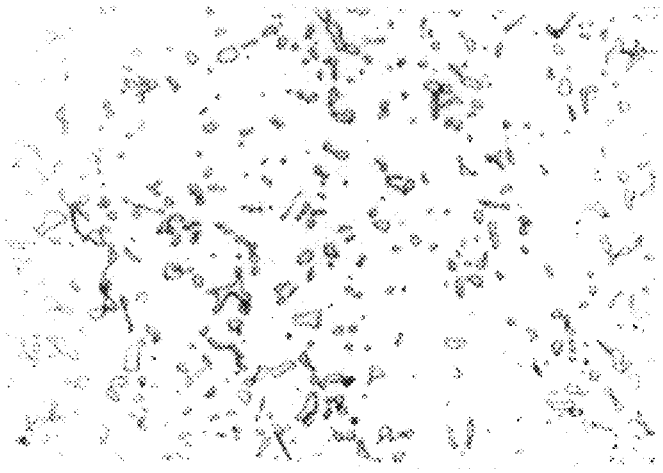
FIG. 3(*a*) and FIG. 3(*b*) are micrographs of the metallographic structures of the materials after spheroidizing annealing: whereas FIG. 3(*a*) shows an example according to the present invention, FIG. 3(*b*) shows an example of conventional materials.
Figure 3B:
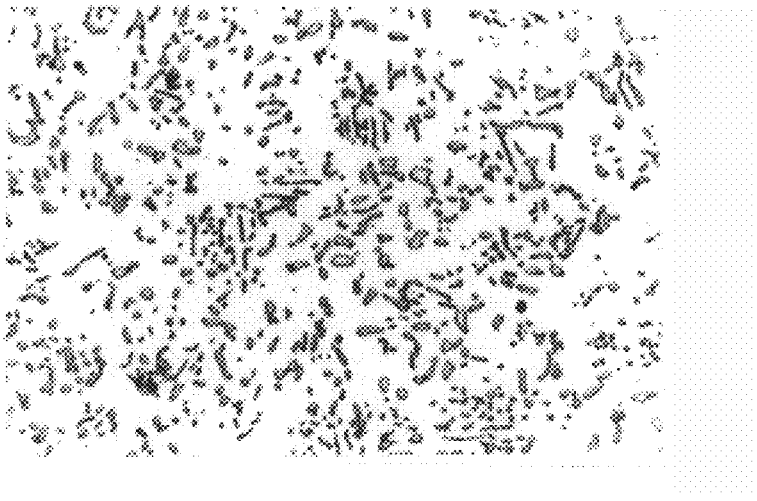

FIG. 3(*a*) and FIG. 3(*b*) are micrographs (×1,000) of the materials after spheroidizing annealing. FIG. 3(*a*) is a micrograph of the material of FIG. 2(*a*) after spheroidizing annealing; and FIG. 3(*b*) is that of the material of FIG. 2(*b*) after preliminary drawing and spheroidizing annealing. As is seen in FIG. 3(*a*), the material according to the present invention after the spheroidizing annealing has a structure in which are dispersed fine cementite granules having a ferrite crystal grain size number of 11 or higher as defined under JIS G 0552 and a spheroidizing index of No. 2 or below (for example No. 1, No. 1.5 or No. 2) as defined under JIS G 3545, as an after-effect of the history of fine crystal grains formed during the low temperature rolling. A high critical upsetting ratio is obtained thanks to the ferrite crystal grain size number of 11 or higher as described above. As a result, the spheroidizing-annealed material according to the present invention has high ductility, with the reduction of area 5 to 10% higher than conventional materials.

As shown in FIG. 3(*a*) and FIG. 3(*b*), the material according to the present invention has, even without preliminary drawing prior to spheroidizing annealing, a structure with cementite granules dispersed in the ferrite, as seen in the conventionally treated material. At tensile tests, both materials equally showed a tensile strength level of about 500 MPa, and it was confirmed that the annealed material according to the present invention had a cold workability equal or superior to the conventionally annealed material. Note that the present invention is applicable to not only steel wire rods but also small diameter steel bars in the same way.

Hereafter explained are the reasons why the chemical composition of the object steel is limited in the present invention.

C is an indispensable element for enhancing steel strength required for machine structural components and, with a C content less than 0.1%, the strength of final products is insufficient but, with a C content exceeding 0.5%, the toughness of the final products is deteriorated. The C content is, therefore, limited to 0.1 to 0.5%.

Si is added as a deoxidizing agent and to increase the strength of final products through solid solution hardening. A Si content below 0.01% is insufficient for obtaining the above effects but, when it is added in excess of 0.5%, these effects do not increase any more and, adversely, toughness is deteriorated. The Si content is, therefore, limited to 0.01 to 0.5%. It has to be noted that, besides Si, Al can also be used for the deoxidation of a steel. For lowering oxygen content, in particular, it is preferable to use Al which is a strong deoxidizing agent. In such a case, 0.2% or less of Al may remain in the steel, but an Al content of this level is tolerable in the present invention.

Mn is effective for enhancing the strength of final products through the enhancement of hardenability but, with a Mn content below 0.3%, a sufficient effect is not obtained and, with an addition in excess of 1.5%, the effect becomes saturated and, adversely, toughness is lowered. The Mn content is, therefore, limited to 0.3 to 1.5%.

S is an element inevitably included in steel and exists there in the form of MnS. Its content of 0.1% or less is tolerable in the present invention, for S contributes to the improvement of machinability and the formation of fine crystal structure. However, since S is detrimental to cold formability, it is preferable to limit its content to 0.035% or less when machinability is not required.

P is also an element inevitably included in steel, but it causes grain boundary segregation and center segregation, deteriorating toughness. It is, therefore, preferable to limit the P content to 0.035% or less.

While the fundamental chemical composition of the object steel of the present invention is as described above, the present invention further provides that one or more of Cr, Mo, Ni, Cu and B may be added. These elements are added to increase the strength of final products through the enhancement of hardenability and other effects. However, since the addition of these elements in large quantities increases hardness through the formation of bainite and martensite in the as hot-rolled condition, besides being uneconomical, their contents are limited as follows:

0.2 to 2.0% of Cr, 0.1 to 1.0% of Mo, 0.3 to 1.5% of Ni, 1.0% or less of Cu, and 0.005% or less of B.

Further, the present invention provides that one or more of Ti, Nb and v may be added for the purpose of grain size control. The effect is, however, insufficient when the content of Ti, Nb or V is below 0.005, 0.005 or 0.03%, respectively. On the other hand, when the content exceeds 0.04, 0.1 or 0.3%, respectively, the effect does not increase further but toughness is deteriorated. The contents of these elements are, therefore, limited as follows:

0.005 to 0.04% of Ti, 0.005 to 0.1% of Nb, and 0.03 to 0.3% of V.

The method to produce a steel wire rod for cold forging according to the present invention is described hereafter.

Steel billets are rough hot rolled and then finish hot rolled into wire rods of a prescribed shape in the temperature range from $Ar_3$ to 200° C. above it. Fine crystal grains having a prior austenite grain size number of 11 or higher, as defined under JIS G 0551, can be obtained by the finish hot rolling at a temperature immediately above $Ar_3$. It is preferable to control the finish hot-rolling temperature to immediately above $Ar_3$, lower than conventional rolling temperatures, but a temperature up to 200° C. above it is tolerable. A rolling temperature below $Ar_3$ is not acceptable, for ferrite precipitates in the temperature range.

The finish hot-rolled steel wire rods are rapidly cooled by laying them on a conveyer in continuous rings in order to form the martensite, bainite or bainite-martensite structure, and then re-formed into packed coils.

The reason why the wire rods are laid in the form of continuous rings for rapid cooling is that the entire wire rods are evenly cooled in this way, and, in other words, if cooled in the form of collected and bundled coils, there will be a temperature difference between the outer and inner portions of the bundled coils and the structure becomes uneven owing to the uneven cooling. In addition, the object of making the structure of martensite, bainite or bainite-martensite is to distribute carbon virtually evenly so that spheroidizing takes place easily during annealing.

Any known means of cooling such as cold water, warm water of 20 to 99° C. or air blast may be used for the rapid cooling.

Then, the bundled coils are tempered by holding them in a furnace atmosphere controlled in the temperature range of 300 to 600° C. for 15 min. or longer but shorter than 1 h., before banding tightly.

The tempering treatment is applied for the purpose of stress relieving and dehydrogenation to prevent the delayed failure (the phenomenon of a quenched steel material cracking while kept at room temperature). The diffusive hydrogen is released from the steel in the temperature range from 300 to 600° C.

In order to release the diffusive hydrogen to attain a concentration of 0.2 ppm or less, it is necessary to temper the materials at least for 15 min. or longer. If the tempering time is too long, on the other hand, the diffusive hydrogen concentrates locally at portions where stress concentrates, making the delayed failure likely to occur. The tempering time is, therefore, limited to less than 1 h.

A spheroidizing-annealed steel wire rod for cold forging, excellent in ductility and having a ferrite crystal grain size number of 11 or higher as defined under JIS G 0552 and a spheroidizing index of No. 2 or below as defined under JIS G 3545, is thus obtained through the spheroidizing annealing of a tempered wire rod.

EXAMPLE 1

The present invention is explained more specifically hereafter based on examples.

Table 1 shows the chemical compositions of specimens. All the specimens were produced by the continuous casting of the steels after melting in a converter, then cast blooms were broken down into billets 162 mm×162 mm in section and then the billets were rolled into wire rods 11 mm in diameter under the conditions listed in Table 2. The specimens of rolling No. I conforming to the present invention were finish hot rolled at 800° C., within the temperature range from $Ar_3$ to 200° C. above it, laid on a conveyer in the form of rings, rapidly cooled with cold water, warm water or air blast, collected into bundled coils, and then tempered by holding them for 30 min. in a furnace atmosphere controlled to the temperature of 500° C. before being banded. The specimens were then annealed for spheroidizing at the retention temperature of 740° C. for the resident time of 17 h. without preliminary drawing.

The materials of rolling No. II, which are comparative specimens, were finish hot rolled at 900° C., then underwent a controlled cooling on a coil transfer line covered with a slow cooling cover. Thereafter, they underwent surface lubrication treatment and drawing, the so-called preliminary drawing, from the diameter of 11 mm to 9.4 mm, and then spheroidizing annealing under the same condition as the specimens according to the present invention.

For the purpose of evaluating the properties in the as rolled state (in the state after rolling, rapid cooling and tempering in the case of the specimens according to the present invention), the specimens were measured in terms of: their microstructure and prior austenite grain size, which had influence on spheroidizing behavior and the ductility after spheroidizing annealing; and the amount of the diffusive hydrogen, which had influence on the occurrence of the delayed failure. Their tensile strength and spheroidizing ratios were also evaluated as the indicators of the degree of spheroidizing. The reduction of area and the critical upsetting ratios were also measured on the specimens after the spheroidizing annealing as indicators of ductility. These evaluation items are listed in Table 3 comparing the invented and comparative specimens.

As is clear from the table, a good granular structure is obtained with the comparative specimens of rolling No. II through the application of the preliminary drawing. It was confirmed, however, that the present invention could achieve, without the preliminary drawing, a good spheroidized structure, furthermore, a better reduction of area than the comparative specimens by about 5 to 10%, and extremely high ductility with the critical upsetting ratio better than the comparative specimens by 5%.

TABLE 1

| | (wt %) | | | | | | | | | | | | | |
|---|---|---|---|---|---|---|---|---|---|---|---|---|---|---|
| Steel No. | C | Si | Mn | P | S | Cr | Mo | Al | Ni | Cu | B | Ti | Nb | V |
| A | 0.44 | 0.23 | 0.78 | 0.014 | 0.025 | 0.05 | — | 0.023 | — | — | — | — | — | — |
| B | 0.40 | 0.24 | 0.68 | 0.011 | 0.010 | — | — | 0.025 | — | — | — | — | — | — |
| C | 0.35 | 0.25 | 0.70 | 0.013 | 0.008 | — | — | 0.025 | — | — | — | — | — | — |
| D | 0.25 | 0.23 | 0.71 | 0.012 | 0.010 | — | — | 0.024 | — | — | — | — | — | — |
| E | 0.40 | 0.25 | 0.77 | 0.020 | 0.020 | 1.02 | — | 0.032 | — | — | — | — | — | — |
| F | 0.35 | 0.19 | 0.80 | 0.015 | 0.022 | 1.00 | 0.18 | 0.033 | — | — | — | — | — | — |
| G | 0.15 | 0.20 | 0.55 | 0.013 | 0.022 | 0.55 | 0.17 | 0.029 | 0.55 | — | — | — | — | — |
| H | 0.25 | 0.26 | 0.35 | 0.010 | 0.009 | — | — | 0.030 | — | — | 0.0018 | 0.02 | — | — |
| I | 0.45 | 0.04 | 0.35 | 0.014 | 0.006 | — | — | 0.020 | — | — | 0.0020 | 0.02 | — | — |
| J | 0.25 | 0.20 | 0.35 | 0.008 | 0.008 | — | — | 0.035 | — | 0.20 | 0.0016 | 0.04 | — | — |
| K | 0.24 | 0.23 | 0.34 | 0.010 | 0.015 | — | — | 0.030 | — | — | 0.0020 | 0.02 | 0.05 | — |
| L | 0.25 | 0.25 | 0.37 | 0.011 | 0.014 | — | — | 0.025 | | — | 0.0025 | 0.02 | — | 0.10 |

TABLE 2

| Classification | Rolling No. | Rolled diameter (mm) | Finish rolling temperature (° C.) | Cooling after rolling | Preliminary drawing | Spheroidizing annealing |
|---|---|---|---|---|---|---|
| Inventive specimen | I-1 | 11 | 800 | Cold water cooling and tempering | Not applied | High temperature holding at 740° C. and resident time of 17h. |
| Inventive specimen | I-2 | 11 | 800 | Warm water cooling and tempering | Not applied | |
| Comparative specimen | II | 11 | 900 | Cooling with slow cooling cover | Applied | |

TABLE 3

| | | | | As rolled material | | | | | Spheroidizing-annealed material | | |
|---|---|---|---|---|---|---|---|---|---|---|---|
| Classification | Symbol | Steel No. | Rolling No. | Micro-structure | Prior austenite grain size number | Tensile strength (MPa) | Amount of diffusive hydrogen (ppm) | Tensile strength (MPa) | Spheroidizing ratio (%) | Reduction of area (%) | Critical upsetting ratio (%) |
| Inventive specimen | 1 | A | I-1 | M | 11.9 | 978 | 0.05 | 489 | 95 | 71 | 85 |
| Comparative specimen | 2 | " | II | F + P | 8.7 | 704 | — | 497 | 90 | 65 | 80 |
| Inventive specimen | 3 | B | I-1 | M | 11.8 | 765 | 0.03 | 469 | 95 | 72 | 85 |
| Comparative specimen | 4 | " | II | F + P | 8.5 | 653 | — | 474 | 90 | 64 | 80 |
| Inventive specimen | 5 | C | I-1 | M | 11.5 | 713 | 0.03 | 449 | 95 | 73 | 90 |
| Comparative specimen | 6 | " | II | F + P | 8.8 | 591 | — | 457 | 90 | 65 | 85 |
| Inventive specimen | 7 | D | I-1 | M | 12.0 | 690 | 0.05 | 408 | 95 | 74 | 90 |
| Comparative specimen | 8 | " | II | F + P | 9.0 | 511 | — | 428 | 90 | 66 | 85 |

TABLE 3-continued

| Classification | Symbol | Steel No. | Rolling No. | As rolled material: Micro-structure | Prior austenite grain size number | Tensile strength (MPa) | Amount of diffusive hydrogen (ppm) | Tensile strength (MPa) | Spheroidizing-annealed material: Spheroidizing ratio (%) | Reduction of area (%) | Critical upsetting ratio (%) |
|---|---|---|---|---|---|---|---|---|---|---|---|
| Inventive specimen | 9 | E | I-2 | Zw | 12.1 | 931 | 0.04 | 539 | 95 | 70 | 85 |
| Comparative specimen | 10 | " | II | F + P | 9.1 | 748 | — | 547 | 90 | 62 | 80 |
| Inventive specimen | 11 | F | I-2 | Zw | 12.2 | 947 | 0.03 | 555 | 95 | 71 | 85 |
| Comparative specimen | 12 | " | II | F + P | 8.9 | 734 | — | 564 | 90 | 63 | 80 |
| Inventive specimen | 13 | G | I-2 | Zw | 12.1 | 890 | 0.05 | 545 | 95 | 70 | 90 |
| Comparative specimen | 14 | " | II | F + P | 9.1 | 748 | — | 568 | 90 | 65 | 85 |
| Inventive specimen | 15 | H | I-2 | Zw | 11.5 | 824 | 0.06 | 412 | 95 | 73 | 90 |
| Comparative specimen | 16 | " | II | F + P | 8.9 | 646 | — | 459 | 90 | 63 | 85 |
| Inventive specimen | 17 | I | I-2 | Zw | 11.3 | 879 | 0.03 | 408 | 95 | 73 | 90 |
| Comparative specimen | 18 | " | II | F + P | 9.2 | 571 | — | 459 | 90 | 64 | 85 |
| Inventive specimen | 19 | J | I-2 | Zw | 11.4 | 851 | 0.04 | 418 | 95 | 72 | 90 |
| Comparative specimen | 20 | " | II | F + P | 9.3 | 662 | — | 469 | 90 | 65 | 85 |
| Inventive specimen | 21 | K | I-2 | Zw | 12.5 | 880 | 0.05 | 422 | 90 | 70 | 90 |
| Comparative specimen | 22 | " | II | F + P | 9.2 | 662 | — | 477 | 80 | 63 | 85 |
| Inventive specimen | 23 | L | I-2 | Zw | 12.4 | 945 | 0.05 | 473 | 90 | 67 | 90 |
| Comparative specimen | 24 | " | II | F + P | 9.4 | 713 | — | 527 | 80 | 60 | 85 |

F: ferrite; P: pearlite; Zw: bainite; M: martensite

*: Comparative specimens cooled with slow cooling cover are measured after coiling and water-cooling.

As explained hereinbefore, by the present invention, it is possible to produce high quality annealed steel wire rods at high productivity and low cost, because the present invention makes the spheroidizing annealing viable without preliminary drawing, which has been conventionally an indispensable pretreatment for the spheroidizing annealing, and secures excellent ductility of the annealed materials.

What is claimed is:

1. A steel wire rod for cold forging characterized by: containing, by weight, 0.1 to 0.5% of C, 0.01 to 0.5% of Si, and 0.3 to 1.5% of Mn, with the balance consisting of Fe and unavoidable impurities; and having a structure mainly composed of martensite, bainite, martensite+bainite, or their tempered structure; and having a prior austenite grain size number, defined under Japanese Industrial Standard (JIS) G 0551, of 11 or higher, the amount of diffusible hydrogen in the steel measured by the programmed temperature gas chromatography being 0.2 ppm or less, and the hardness being Hv 250 to 700.

2. A steel wire rod for cold forging, characterized by: containing, by weight, 0.1 to 0.5% of C, 0.01 to 0.5% of Si, and 0.3 to 1.5% of Mn, with the balance consisting of Fe and unavoidable impurities; and having a structure mainly composed of martensite, bainite, martensite+bainite, or their tempered structure; and having a ferrite crystal grain size number, defined under JIS G 0552, of 11 or higher, and the spheroidizing index defined under JIS G 3545 being No. 2 or below.

3. A steel wire rod for cold forging according to claim 1 or 2 characterized by further containing, by weight, one or more of, 0.2 to 2.0% of Cr, 0.1 to 1.0% of Mo, 0.3 to 1.5% of Ni, 1.0% or less of Cu, and 0.005% or less of B.

4. A steel wire rod for cold forging according to claim 1 or 2, characterized by further containing, by weight, one or more of, 0.005 to 0.04% of Ti, 0.005 to 0.1% of Nb, and 0.03 to 0.3% of V.

5. A method to produce a steel wire rod for cold forging characterized by hot rolling a steel having a chemical composition comprising, by weight, 0.1 to 0.5% of C, 0.01 to 0.5% of Si, and 0.3 to 1.5% of Mn at a finish rolling temperature range from the $Ar_3$ transformation temperature to 200° C. above it, rapidly cooling the steel wire rod thus rolled by laying it on a conveyer in the form of continuous rings in order to form a martensite, bainite or bainite-martensite structure and, after collecting the wire rod into a bundled coil and before banding it, tempering the coiled wire rod by holding it in a furnace atmosphere controlled to a temperature range from 300 to 600° C. for 15 mm. or longer but shorter than 1 h., so that the prior austenite grain size number, defined under JIS G 0551, is 11 or higher, the amount of diffusible hydrogen in the steel measured by the programmed temperature gas chromatography is 0.2 ppm or less, and the hardness thereof is Hv 250 to 700.

6. A method to produce a steel wire rod for cold forging characterized by applying spheroidizing annealing subsequent to the production processes according to claim 5 so that the ferrite crystal grain size number, defined under JIS G 0552, is 11 or higher, and the spheroidizing index defined under JIS G 3545 is No. 2 or below.

* * * * *